US006758070B2

(12) United States Patent
Yu et al.

(10) Patent No.: US 6,758,070 B2
(45) Date of Patent: Jul. 6, 2004

(54) DOOR LOCK WITH A CLUTCH HAVING A CAM-STYLED AXLE SLEEVE

(76) Inventors: Jer Ming Yu, 13Fl.-3, No. 266, Sec. 1, Wenhua 2nd Rd., Linkou Shiang, Taipei (TW); Chao-Ming Cheng, No. 17, Lane 410, Julin Rd., Linkou Shiang, Taipei (TW); Chen-Chien Chen, No. 2, Lane 476, Huacheng Rd., Shinjuang City, Taipei (TW)

( * ) Notice: Subject to any disclaimer, the term of this patent is extended or adjusted under 35 U.S.C. 154(b) by 0 days.

(21) Appl. No.: 10/458,222

(22) Filed: Jun. 11, 2003

(65) Prior Publication Data

US 2004/0040353 A1 Mar. 4, 2004

Related U.S. Application Data

(63) Continuation-in-part of application No. 10/230,994, filed on Aug. 30, 2002.

(51) Int. Cl.[7] ..... E05B 47/06

(52) U.S. Cl. ..... 70/107; 70/223; 70/277; 70/472; 292/144; 292/336.3

(58) Field of Search ..... 70/107, 217, 218, 70/221, 223, 224, 472, 277–283.1; 292/336.3, 144

(56) References Cited

U.S. PATENT DOCUMENTS 4,820,330 A * 4/1989 Lin ..... 70/277
5,010,752 A * 4/1991 Lin ..... 70/277
5,027,629 A * 7/1991 Liu ..... 70/277
5,040,391 A * 8/1991 Lin ..... 70/277
6,032,991 A * 3/2000 Yeh ..... 292/336.3
6,145,353 A * 11/2000 Doucet ..... 70/277
6,581,426 B2 * 6/2003 Bates et al. ..... 70/278.7
6,585,302 B2 * 7/2003 Lin ..... 292/142
2001/0005998 A1 * 7/2001 Imedio Ocana ..... 70/277
2003/0084690 A1 * 5/2003 Ruano Aramburu et al. . 70/218

* cited by examiner

*Primary Examiner*—Suzanne Dino Barrett
(74) *Attorney, Agent, or Firm*—Troxell Law Office PLLC

(57) ABSTRACT

A door lock with a clutch having a cam-styled axle sleeve comprises mainly of an outer lock part and an inner lock part mutually oppositely connected and respectively mounted on the outside and inside surfaces of a door panel, the door panel is mounted therein with a dead bolt and a spring loaded with latch bolt linked up with a rotation axle of the inner lock part, the housings of the outer and the inner lock parts are provided each with a handle to rotate their rotation axles. The rotation axle of the inner lock part has on one end thereof a second rotation axle, the rotation axle of the outer lock part has thereon the cam-styled axle sleeve. By providing a control device and a rotating ring, positioning or forward moving of the cam-styled axle sleeve to connect with the second rotation axle can be controlled, so that the door can be opened or locked by rotating the handles no matter inside or outside a house.

12 Claims, 11 Drawing Sheets

DOOR LOCK WITH A CLUTCH HAVING A CAM-STYLED AXLE SLEEVE

CROSS REFERENCE OF RELATED APPLICATOIN

This is a continuation-in-part application of the applicants' U.S. patent application having a Ser. No. 10/230,994 and a filing date of Aug. 30, 2002.

BACKGROUND OF THE INVENTION

1. Field of the Invention

The present invention is related to a door lock combining with an electronic circuit capable of opening and locking a door just by rotating a handle inside or outside of a house, and especially to a door lock structure with a clutch having a cam-styled axle sleeve, it has an outer lock part and an inner lock part oppositely mounted on the door respectively inside and outside of the latter and being combined with a dead bolt and a spring loaded with latch bolt in a door panel, it is particularly suitable for gates, room doors or the like requiring lock structures.

2. Description of the Prior Art

With the advancement of science and technology and change of the society, styles of door locks are variant; although there have been various door locks in the markets, the function and object of them are just guaranteeing security of residence, convenience of use as well as operation are also the important matters for designing the door locks.

Conventional electronic door locks in the markets are designed by having key holes for the users to unlock the doors with keys considering the possible conditions when the electronic device is damaged or out of electricity; and also for the users to lock the doors with keys or by inputting a security code to the electronic device provided.

The above stated conventional door locks when in an accident (such as a fire alarm, earthquake, etc) can only be opened by decoding the electronic door locks or by manual latches. Thus, people fleeing from the accident will be confused in a hurry and the time for fleeing will be delayed.

In view of the above stated flaws, the inventor of the present invention developed a door lock structure with a clutch having a cam-styled axle sleeve, it not only is different in opening and locking a door lock without complicated steps as those of the conventional locks, but also has the functions of theft proofing as well as fleeing for one's life.

SUMMARY OF THE INVENTION

The object of the present invention is to provide a door lock with a clutch having a cam-styled axle sleeve that can have the functions of theft proofing as well as fleeing for one's life.

Another object of the present invention is to provide a door lock with a clutch having a cam styled axle sleeve, the door lock can be unlocked inside or outside of a house directly by raising or pressing down a handle to control stretching or retracting of a dead bolt and a spring loaded with latch bolt, thereby the object of convenient opening and locking can be obtained.

To achieve the above stated objects, the present invention is comprised mainly of an outer lock part and an inner lock part, the outer lock part includes a housing and an externally connected handle. The housing has therein a rotation axle and a control device; the control device includes a motor, a gear, an abutting block and an electric circuit device. The rotation axle is connected and linked-up on one end thereof with the handle, and is telescopically connected thereover on the other end thereof with a spring and a cam-styled axle sleeve. The axle sleeve is further provided in a slipping over mode externally thereon with a rotating ring, an axle hole extending through the axle sleeve can be engaged therein with the rotation axle and is linked up by the latter. The axle sleeve is provided on an end face thereof with an engaging portion; and is provided on the outer periphery thereof with an engaging edge for abutting of an abutting block of the control device thereon; the rotation axle is provided between the two ends thereof with a fixed pan for abutment of the spring. The electric circuit device can receive electronic signals to control operation of the motor, to move the gear and to link up with the abutting block to raise and lower the latter, and to control forward moving or positioning of the cam styled axle sleeve. And the rotating ring is provided separately thereon with at least two stubs; a flange protrudes out of the periphery of the rotating ring to move the abutting block. The inner lock part includes a housing and an externally connected handle. The housing has therein a rotation axle and a linkage; the rotation axle is connected on one end thereof with the handle for linking up therewith, and is insertion connected on the other end thereof with a second rotation axle. The second rotation axle extends outwardly to form on the tailing end thereof a sheet member of which the external surface is provided with an engaging portion in opposition to the engaging portion of the axle sleeve of the outer lock part to engage with the axle sleeve during forward moving, the sheet member is further provided on the external surface thereof with slots in corresponding by position to those stubs of the rotating ring to make pivot connection with the stubs of the rotating ring, so that the second rotation axle can also be linked up with the rotating ring.

When assembling the present invention on the door, the outer lock part is mounted on the outer side of the door; the inner lock part is mounted on the inner side of the door to be opposite to the outer lock part. The door panel is provided therein with the dead bolt and the spring loaded with latch bolt, thereby the handle for rotating the inner lock part can control stretching from and retracting into the door of the dead bolt and the spring loaded with latch bolt, thereby door opening and locking can be completed. When the axle sleeve of the outer lock part is engaged with the second rotation axle of the inner lock part, rotation of the handle of the outer lock part can also link up with the dead bolt and the spring loaded with latch bolt to likely achieve the object of door opening and locking.

The present invention will be apparent after reading the detailed description of the preferred embodiment thereof in reference to the accompanying drawings.

DETAILED DESCRIPTION OF THE PREFERRED EMBODIMENT

Figure 1:
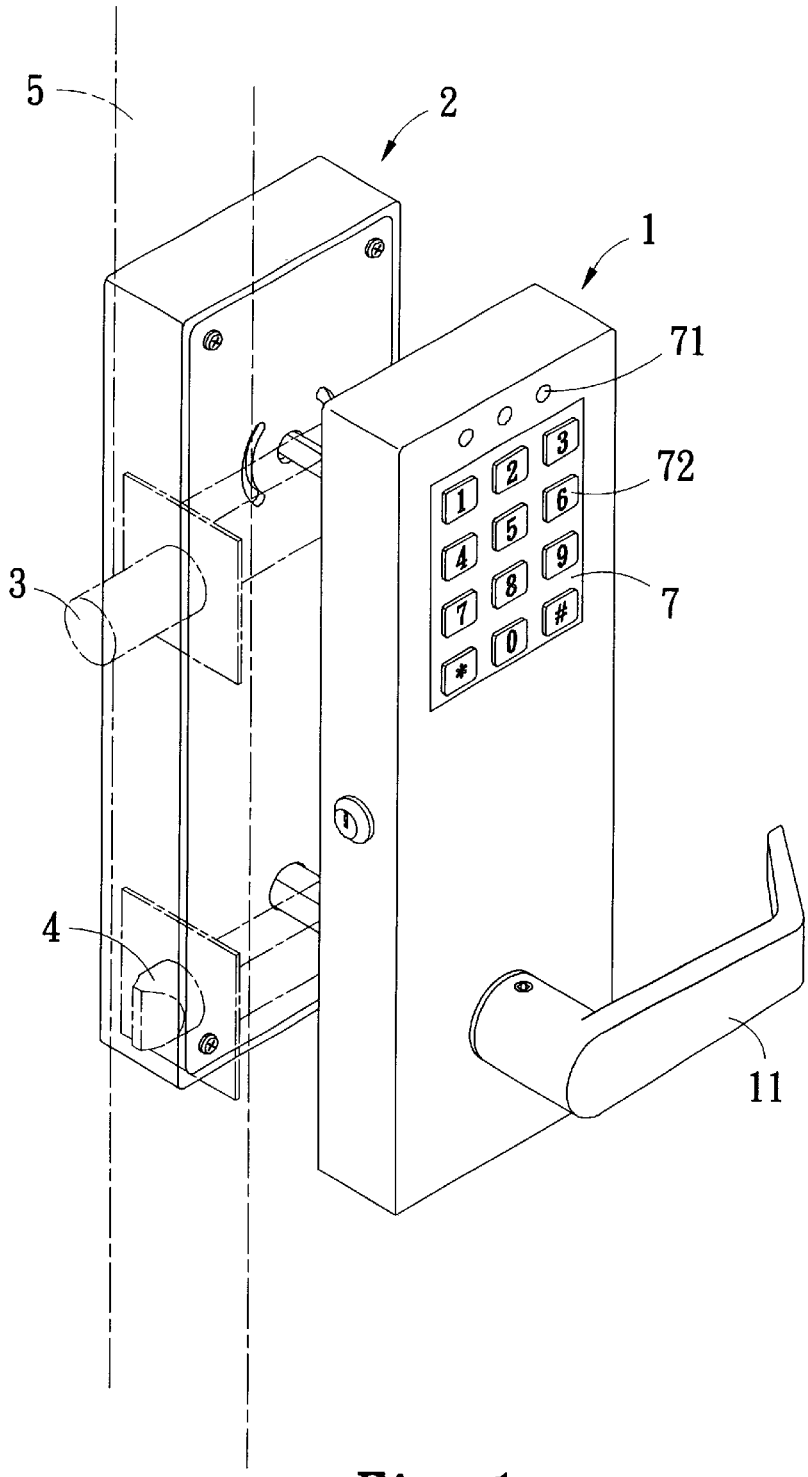
FIG. 1 is a perspective view showing assembling the inner and the outer lock parts of the present invention on a door.

Referring to FIG. 1 showing an embodiment of the door lock with a clutch having a cam-styled axle sleeve of the present invention, the door lock with a clutch having a cam-styled axle sleeve of the present invention mainly is comprised of an outer lock part 1, an inner lock part 2, a dead bolt 3 and a spring loaded with latch bolt 4 mounted together on a door panel 5.

Figure 2:
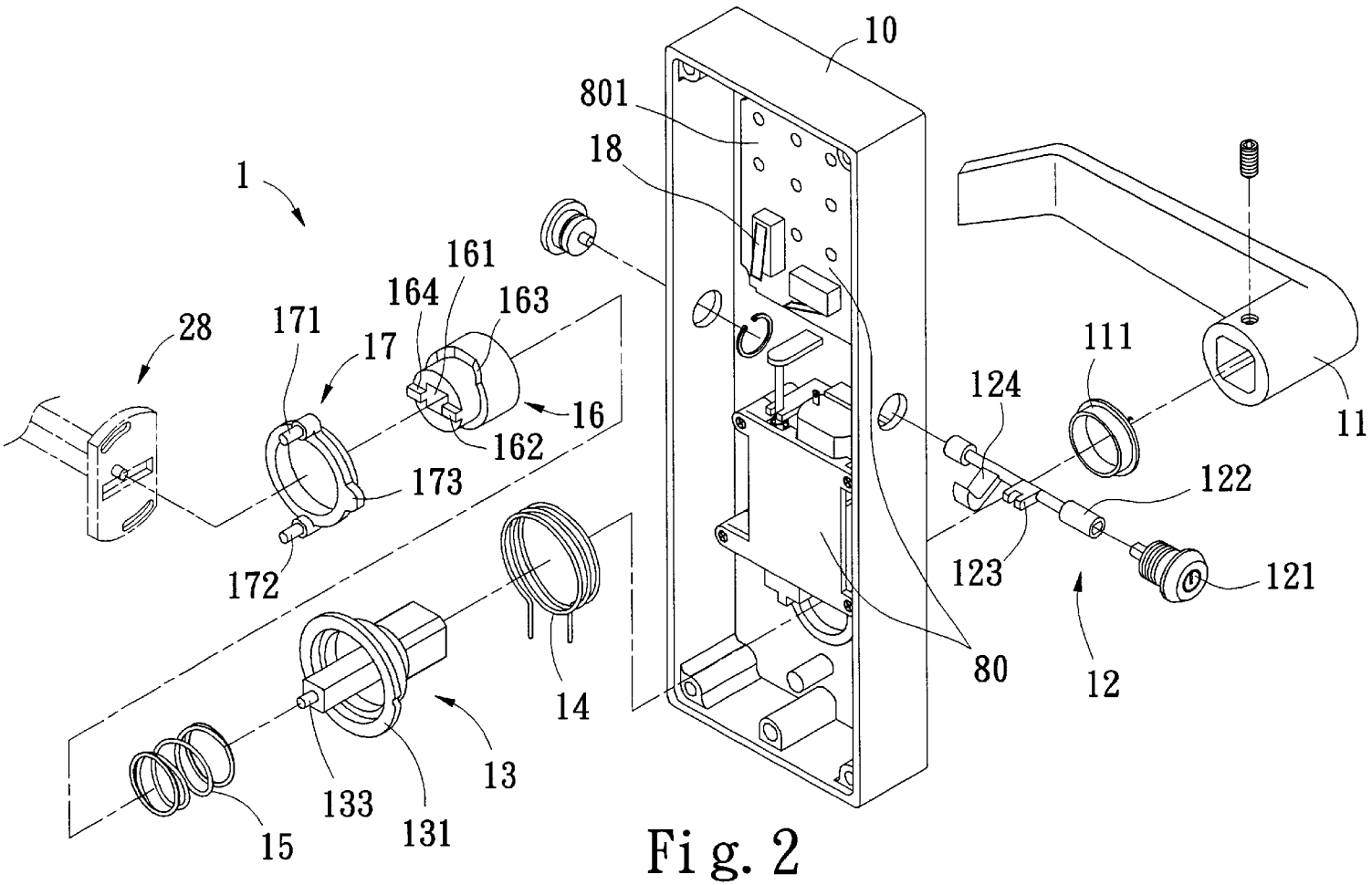
FIG. 2 is an analytic perspective view showing the elements of the outer lock part of the present invention.

Referring to FIG. 2, the outer lock part 1 is composed of a housing 10 and an externally connected handle 11, the housing 10 is extended therein on one side thereof a locking member 12 with a key hole 121 for insertion of a key, at the rear of the key hole 121 there is a lock core rod 122 of which the middle section has a protruding piece 123. The housing 10 has therein a rotating axle 13 and a control device 80. The handle 11 can rotate the inner rotating axle 13, a spring 14 is provided between the two to render the handle 11 to retrieve its original position when the rotating axle 13 is combined with the handle 11. The front and the rear sections of the rotating axle 13 are in the forms of square columns with different sizes, on a stepped surface formed between the two sections with different sizes there is a pan 131 extending outwardly; the end of the section with the larger size is connected to the handle, the end of the section with the smaller size is provided on the end face thereof with a stub 133; this end is slipped thereover a spring 15 and the cam-styled axle sleeve 16 which is further provided in a slipping over mode externally thereon with a rotating ring 17, an axle hole 161 extending centrally through the cam-styled axle sleeve 16 can be engaged therein with the rotation axle 13 and is linked up by the latter. The axle hole 161 has on the two lateral ends thereof two protrusions 162, 164, the cam-styled axle sleeve 16 is provided on the outer periphery thereof with a gradually bevel surface having an engaging edge 163 for abutting of the control device 80 thereon to control forward moving or positioning of the cam-styled axle sleeve 16. And the rotating ring 17 is provided separately thereon with at least two stubs 171, 172; a flange 173 protrudes out of the periphery of the rotating ring 17. The pan 131 formed between the two ends of the rotating axle 13 is provided for abutment thereon of the spring 15, the cam-styled axle sleeve 16 and the rotating ring 17; additionally, the outer lock part 1 is provided externally thereon with a control panel 7 (as shown in FIG. 1) which has at least a display lamp 71 and push buttons 72.

Figure 3:
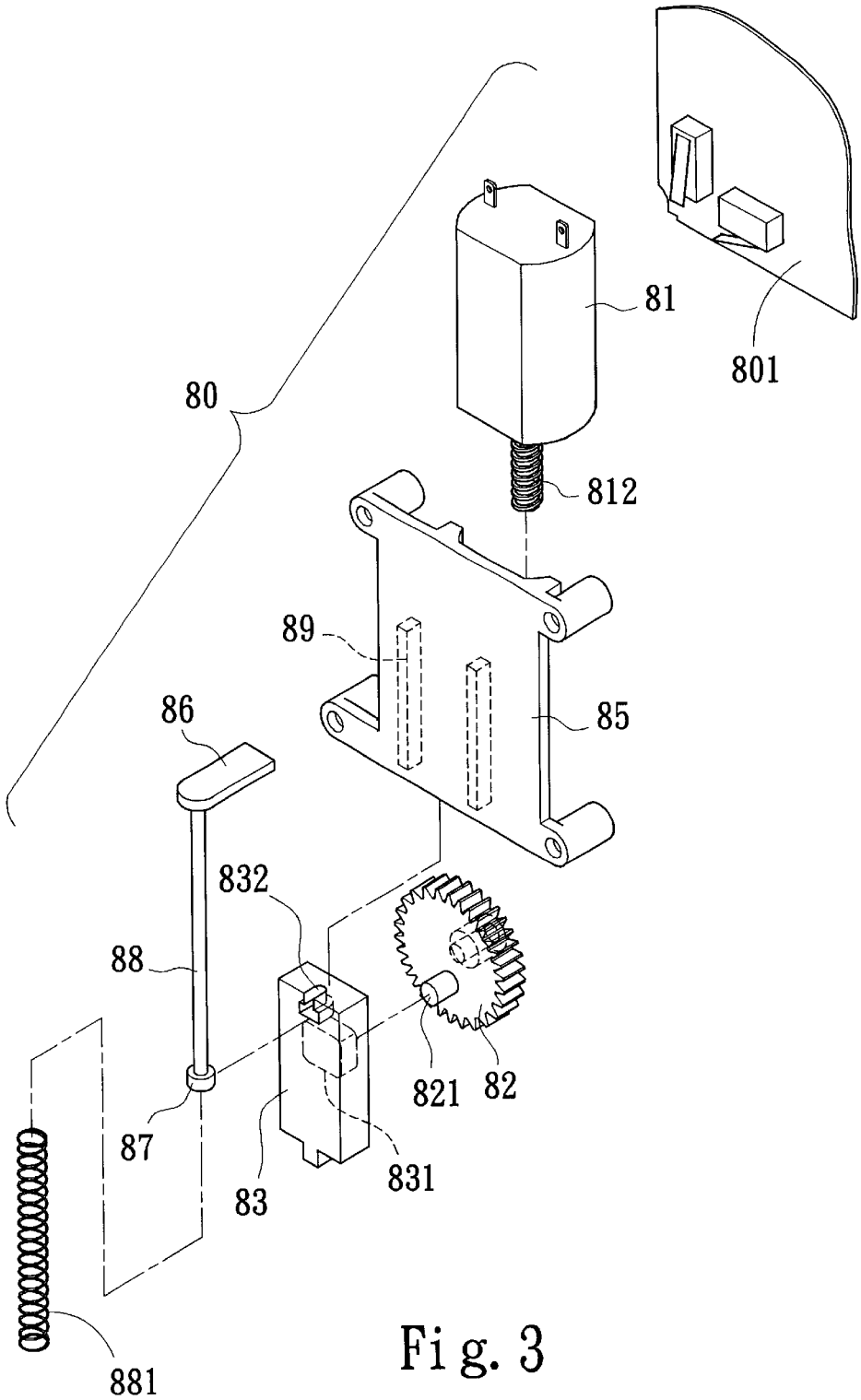
FIG. 3 is an analytic perspective view showing the elements of a control device of the present invention.
Figure 4:
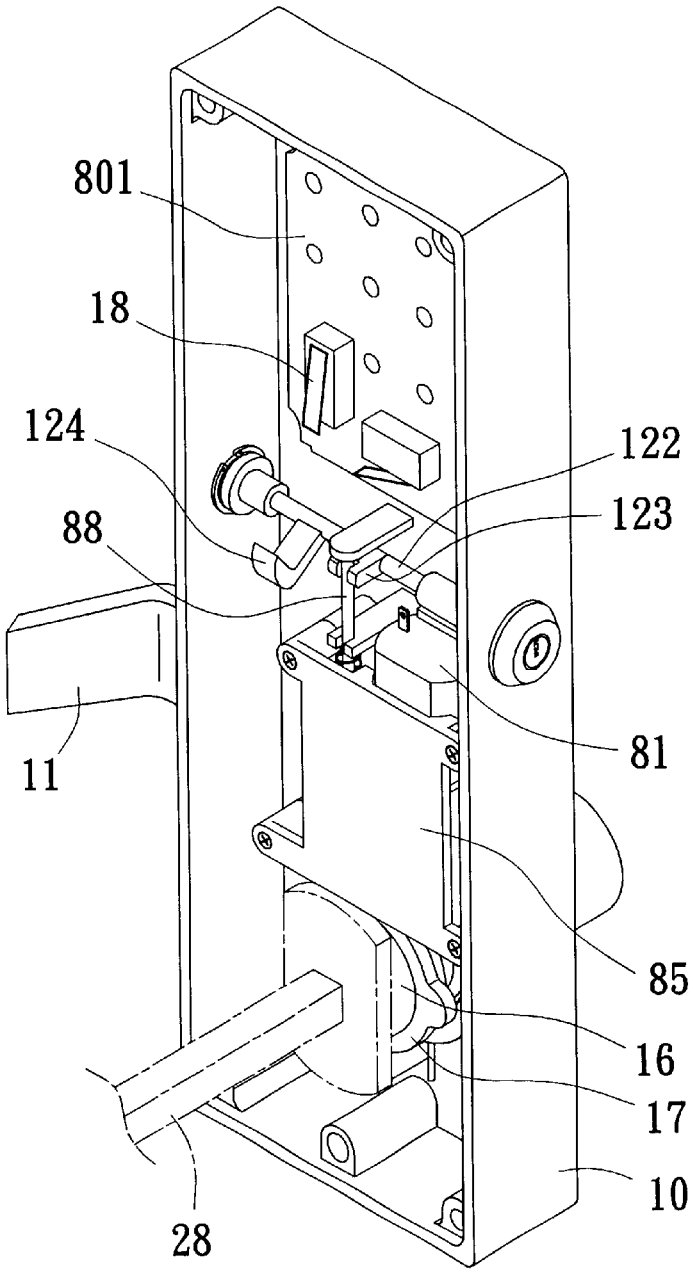
FIG. 4 is a perspective view showing the outer lock part of the present invention after assembling.

As shown in FIGS. 3 and 4, the control device 80 includes: an electric circuit device 801, a motor 81, a gear 82, an abutting block 83, a pull rod 84 and a lid 85; wherein the axle of the motor 81 is a screw rod 812 for engaging by the gear 82, the gear 82 is provided on one side thereof with a recess for positioning of a protrusion on the housing 10, and is provided on the other side thereof with an eccentric protrusion 821 which is for mounting in a recess 831 on the abutting block 83. The abutting block 83 is provided thereon with a positioning recess 832 for positioning of a pull rod 88 having on one end thereof a sheet member 86 and having on the other end thereof a limiting block 87 and being slipped thereover with a spring 881. And the lid 85 having a plurality of positioning strips 89 thereon is locked into the housing 10, so that the abutting block 83 can exactly be engaged thereon the engaging edge 163 of the cam-styled axle sleeve 16. And further as shown in FIG. 4, the pull rod 88 extending out of the lid 85 is engaged with the protruding piece 123 of the locking member 12 (referring to FIG. 4), so that a key can rotate the locking member 12 to move the protruding piece 123 to raise the pull rod 88 which links up with the abutting block 83 to make it leave the engaging edge 163 of the cam-styled axle sleeve 16 to forward the cam-styled axle sleeve 16; or when the electric circuit device 801 provided above the lock core rod 122 receives electronic signals through inputting of the push buttons 72 on the control panel 7 or a remote control (not shown) by a user to control rotation of the motor 81, this can also link up with the abutting block 83 to render it to leave the engaging edge 163 of the cam-styled axle sleeve 16 to forward the cam-styled axle sleeve 16.

Figure 5:
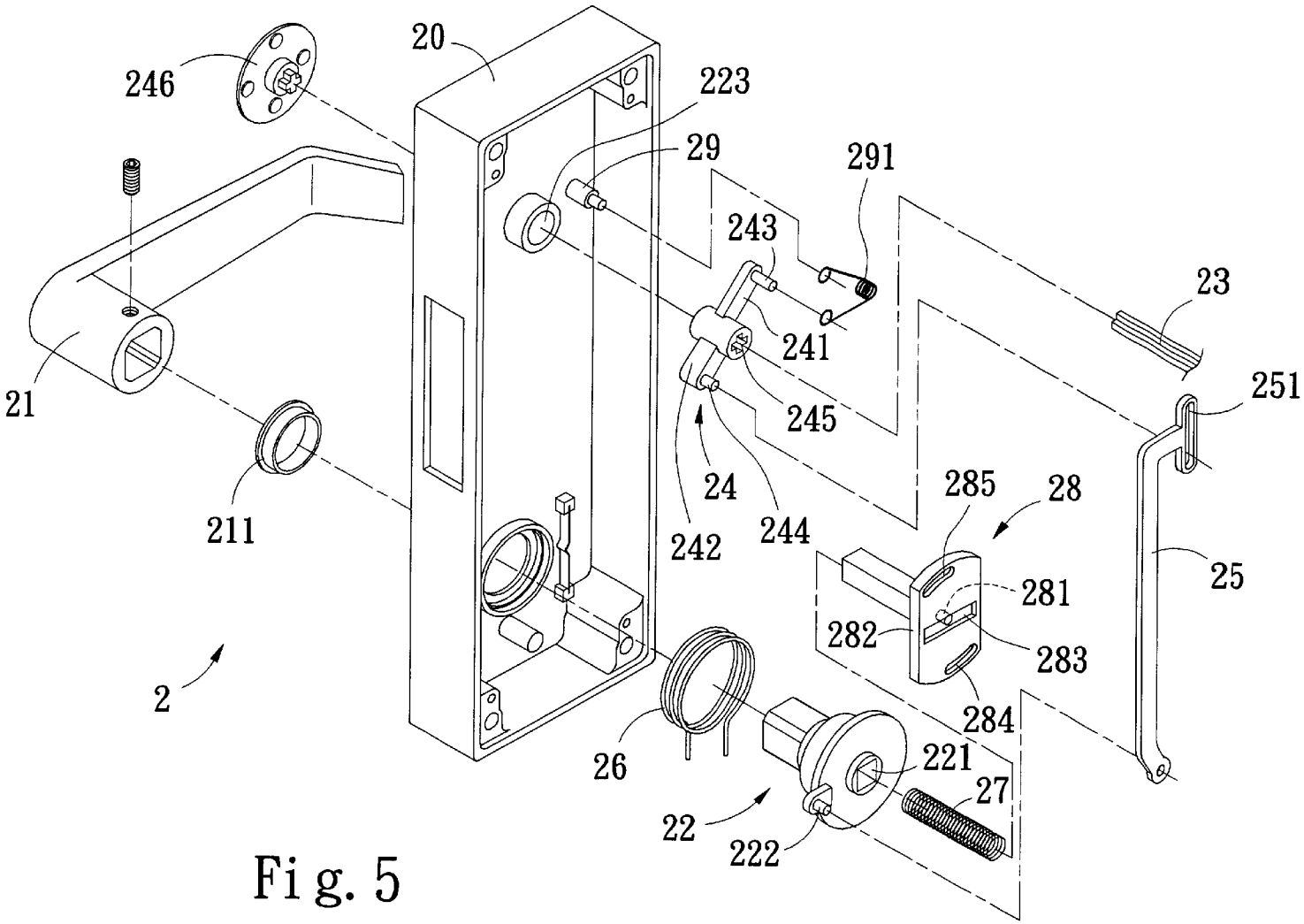
FIG. 5 is analytic perspective view showing the elements of the inner lock part of the present invention.

As shown in FIG. 5, the inner lock part 2 is provided in corresponding by size with the housing 10 of the outer lock part 1, it is composed of a housing 20 and an externally connected handle 21; the housing 20 has therein a linkage composed of a rotation axle 22, a cross shaped axle 23 linking up with the dead bolt 3, an axle seat 24 engaging with the cross shaped axle 23 and an inner pull rod 25. The handle 21 is used for rotating the inner rotation axle 22, one end of the inner rotation axle 22 is a square column, when the inner rotation axle 22 is connected with the handle 21, a spring 26 is placed between them to render the handle 21 to retrieve its original position. The other end of the inner rotation axle 22 is a round plane member with a central axle hole 221 which has therein an abutting spring 27; the abutting spring 27 is connected with an end of a second rotation axle 28 of which the other end extends outwardly to form on the tailing end thereof a sheet member 282 of which the external surface is provided with a recess 283 to engage the protrusions 162, 164 of the cam-styled axle sleeve 16. The recess 283 in an elongate form is provided centrally thereof further with a hole 281 to be engaged and aligned with the stub 133 provided on the end face of the rotating axle 13 on the outer lock part 1. And the sheet member 282 is further provided on the external surface thereof with slots in corresponding by position to those stubs 171, 172 of the rotating ring to make pivot connection with the stubs 171, 172 of the rotating ring, so that the second rotation axle 28 can also be linked up with the rotating ring 17. And more, the central axle hole 221 of the inner rotation axle 22 further has on the end face thereof a linking portion 222 capable of moving the inner pull rod 25; the linking portion 222 is in the form of a stub. The inner pull rod 25 has on the other end thereof an elongate slot 251. The axle seat 24 has two lateral connecting arms 241, 242 thereon of which the tailing ends are respectively provided with stubs 243, 244. The housing 20 of the inner lock part 2 is provided near the axle seat 24 with an engaging seat 29 being engaged thereon with a spring 291; the other end of the spring 291 is engaged with the stub 243 on the lateral connecting arm 241 of the axle seat 24. The elongate slot 251 on the other end of the inner pull rod 25 can be extended therein the stub 244 on the lateral connecting arm 242 of the axle seat 24. And the axle seat 24 is connected with a hole 223 on the housing 20, a cross shaped hole 245 is extended centrally therethrough; the cross shaped hole 245 extends through the housing 20, the end in the housing 20 of the cross shaped hole 245 is for connecting with the cross shaped axle 23 while the end outside of the housing 20 is for connecting with an indication disk 246, there are patterns and colors on the indication disk 246 for recognizing whether the door 5 is locked.

Figure 6:
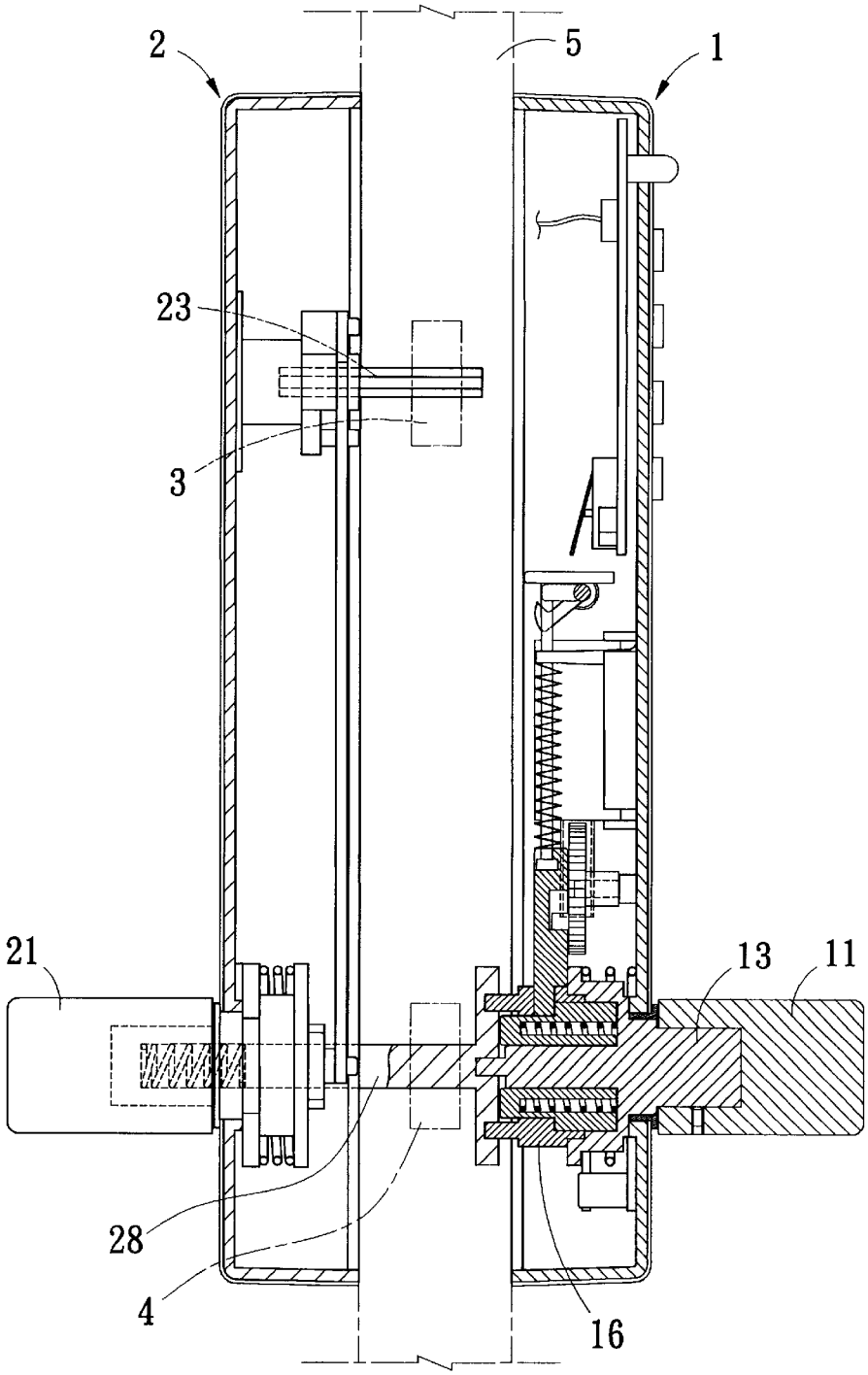
FIG. 6 is a sectional view showing the inner and the outer lock parts of the present invention are combined with the door.

When the embodiment is assembled on the door 5, the dead bolt 3 and the spring loaded with latch bolt 4 are mounted too. Referring to FIG. 6, the inner lock part 2 is mounted on the inner side of the door 5, while the outer lock part 1 is mounted on the outer side of the door 5 in opposition to the inner lock part 2. The dead bolt 3 has thereon a cross shaped hole (not shown) to connect with the cross shaped axle 23 of the inner lock part 2 and is linked up therewith. The spring loaded with latch bolt 4 is vertically connected with the second rotation axle 28 and is linked up therewith. Rotating the handle 21 of the inner lock part 2 can control stretching out of or retracting into the door 5 of the dead bolt 3 and the spring loaded with latch bolt 4, thereby the object of convenience in opening and locking the door 5 can likely be obtained.

Figure 7:
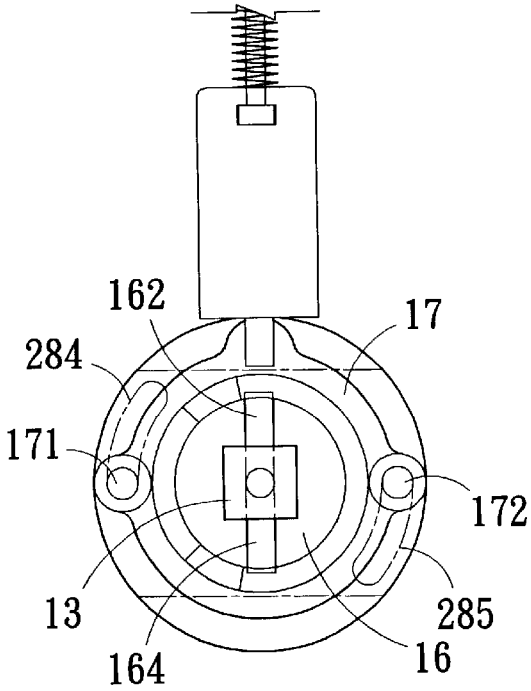
FIG. 7 is a schematic view showing combining of the inner and the outer lock parts before locking.
Figure 7A:
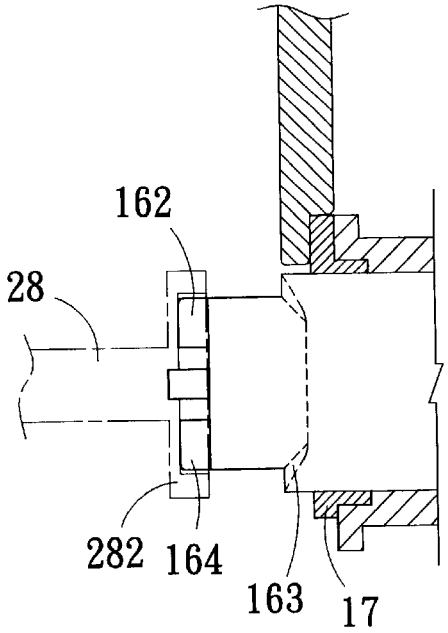
FIG. 7*a* is a schematic sectional side view of FIG. 7.
Figure 8:
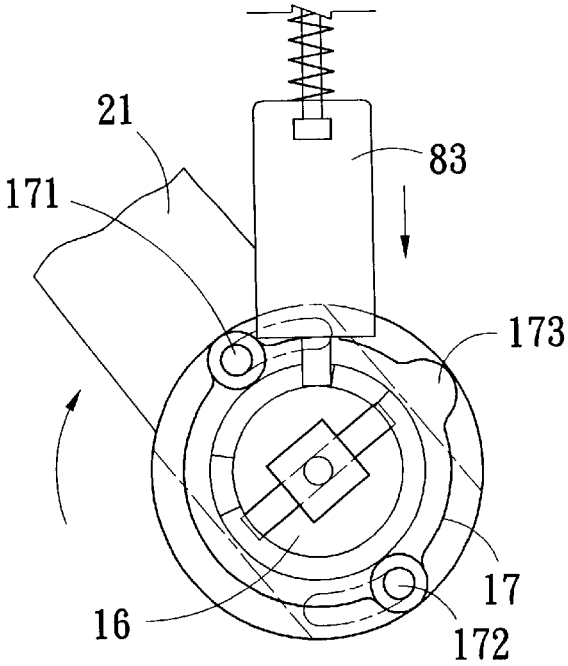
FIG. 8 is a schematic view showing separating the inner lock part from the outer lock part when a handle is raised.
Figure 8A:
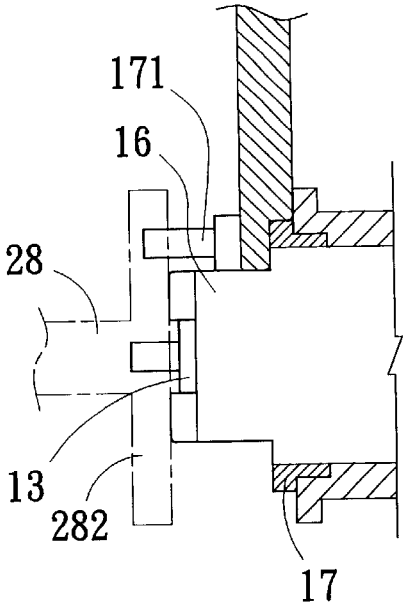
FIG. 8*a* is a schematic sectional side view of FIG. 8.
Figure 8B:
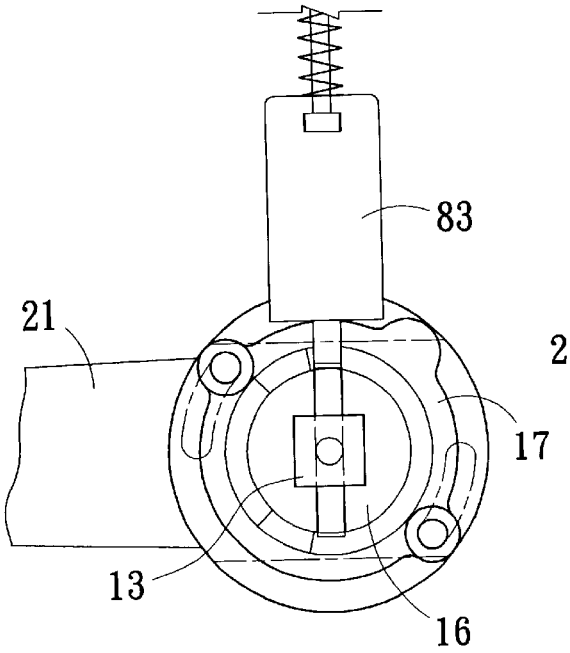
FIG. 8*b* is a schematic view showing the state of the inner lock part and the outer lock part when a handle is raised.
Figure 8C:
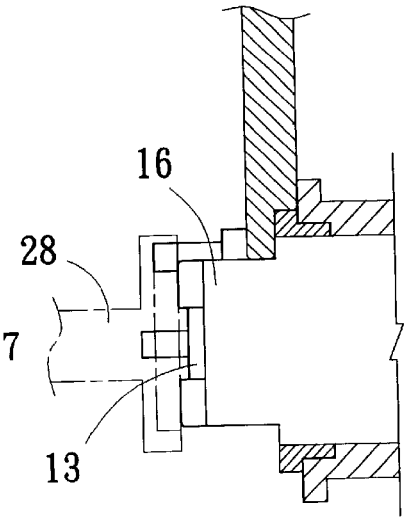
FIG. 8*c* is a schematic sectional side view of FIG. 8*b;*
Figure 9:
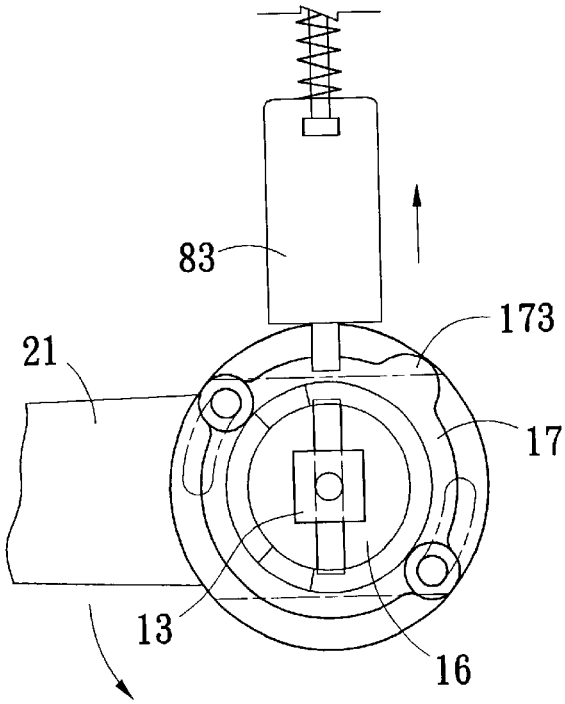
FIG. 9 is a schematic view showing the state of the inner lock part and the outer lock part when a handle is pressed down.

Referring to FIGS. 7, 7*a*, the cam-styled axle sleeve 16 of the outer lock part 1 and the second rotation axle 28 of the inner lock part 2 are in engagement; at this time, the abutting block 83 of the control device 80 has not yet engaged with the engaging edge 163 of the cam-styled axle sleeve 16 to thereby allow forward moving of the cam-styled axle sleeve 16; the two protrusions 162, 164 on the end face of the axle sleeve 16 are engaged into the recess 283 on the sheet member 282 of the second rotation axle 28, and the abutting spring 27 in the central axle hole 221 of the inner rotation axle 22 abuts against one end of the second rotation axle 28, under such a condition, no matter inside or outside of the house, by just pressing down the handles 11, 21, the door 5 can be opened; or by just raising the handles 11, 21, the door 5 can be locked. For more particular understanding of the actions, please refer to FIGS. 8—8*c*, in raising the handles 11, 21, the second rotation axle 28 is moved, and the cross shaped axle 23 linked up therewith too, thereby the dead bolt 3 stretches out of the door 5; meantime, the second rotation axle 28 rotates the cam-styled axle sleeve 16 to rotate the lowest point of the gradually bevel surface of the engaging edge 163 of the cam-styled axle sleeve 16 to where the abutting block 83 is, there is no impedance now, the abutting block 83 is resiliently sent forth downwardly to place one end thereof on the engaging edge 163. When the handles 11, 21 are released to retrieve the engaging edge 163 to their original positions, the abutting block 83 gradually engages the cam-styled axle sleeve 16 along the gradually bevel surface of the engaging edge 163 to retract it for positioning, thereby the second rotation axle 28 is separated from the cam-styled axle sleeve 16. In such a situation, the door 5 can not be opened no matter how the handle 11 is rotated outside of the house; however, by pressing the handle 21 of the inner lock part 2, it can not only open the door 5, but also as shown in FIG. 9, the handle 21 may move the flange 173 of the rotating ring 17 to further move the abutting block 83 upwards, so that the cam-styled axle sleeve 16 is not engaged by it and is forwarded to engage with the second rotation axle 28.

Figure 10:
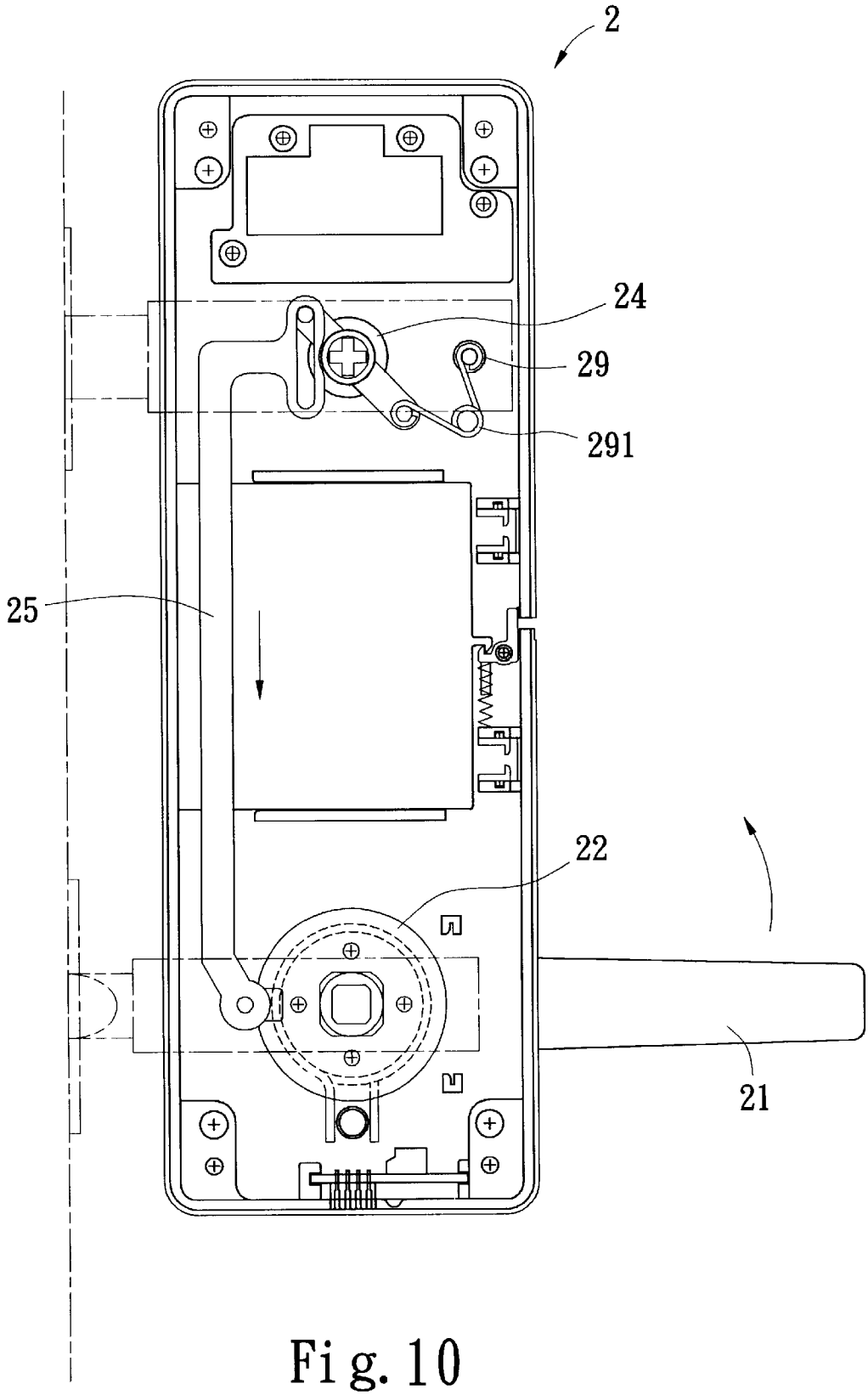
FIGS. 10–12 are schematic sectional views showing the actions of an inner spring and an axle seat of the inner lock part of the present invention when a handle is moved upwardly and downwardly.
Figure 11:
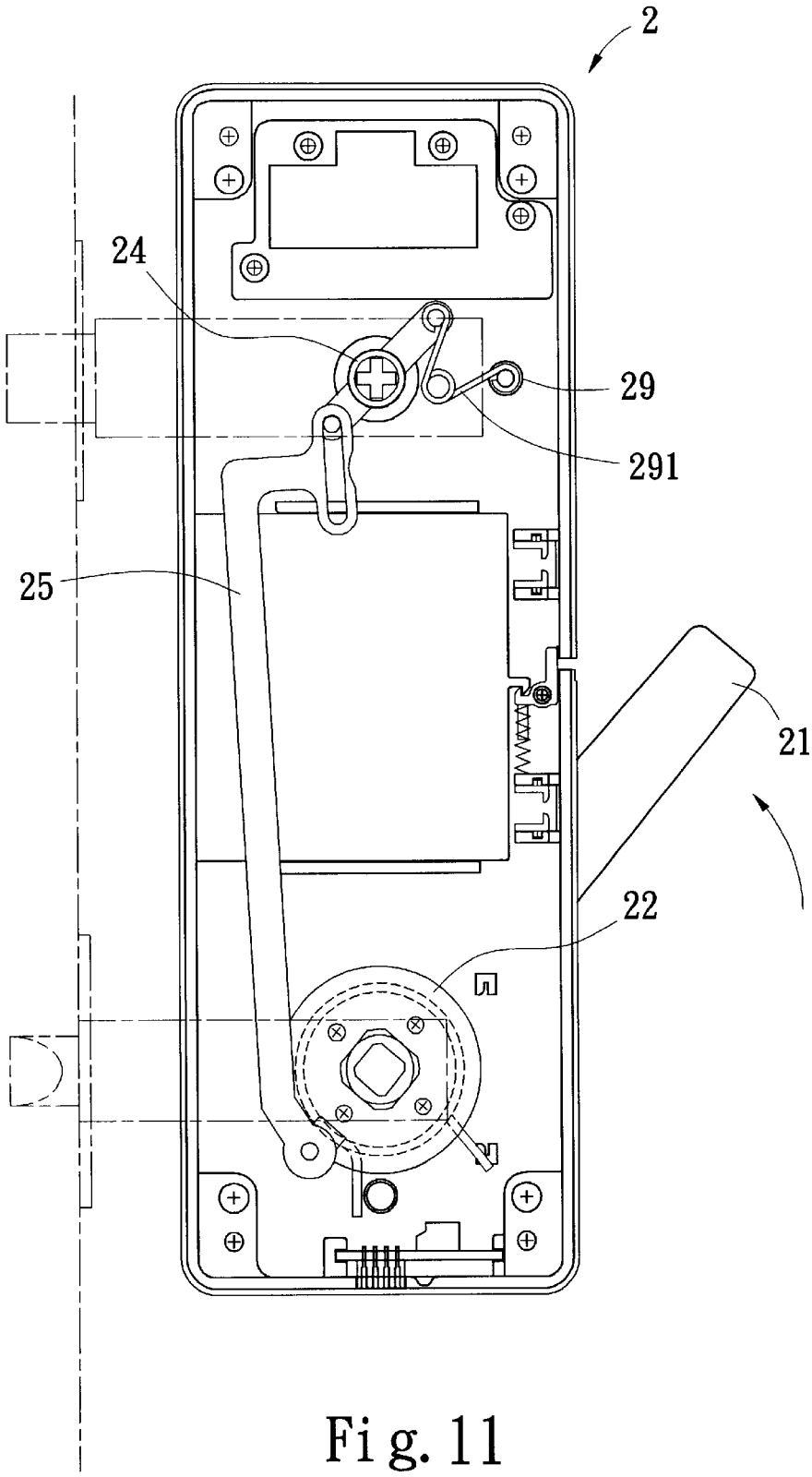
Figure 12:
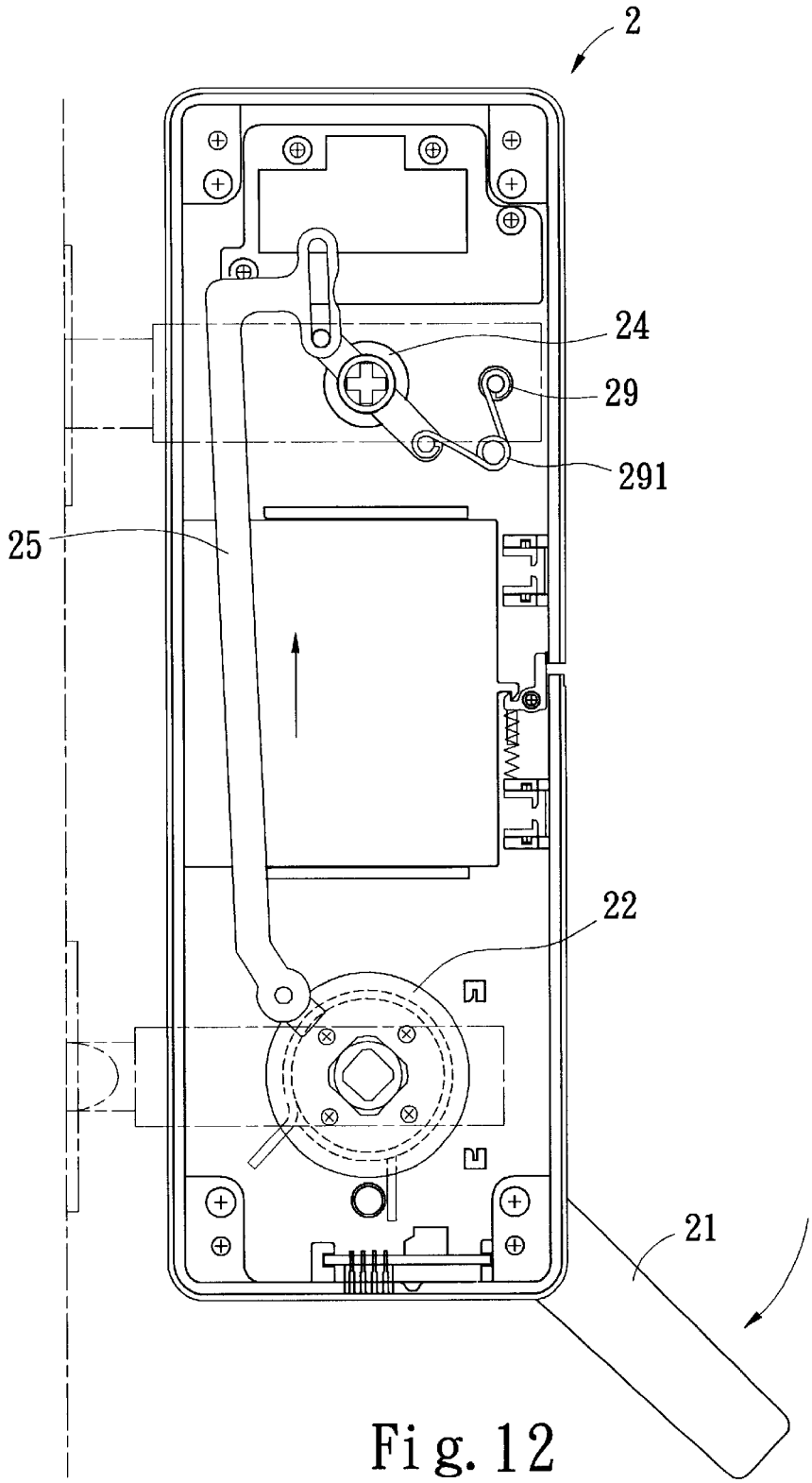

Referring to FIGS. 10–12, to avoid damage of the handles 11, 21 by overly large retrieving spring force after raising or down pressing, this embodiment is provided on the housing 20 of the inner lock part 2 near the axle seat 24 with the engaging seat 29 which is engaged thereon with the spring 291, the other end of the spring 291 is engaged with the axle seat 24, so that the axle seat 24 can be rebounded after is pulled. This can reduce the resilient force of the handles 11, 21 when in retrieving after they are raised and pressed down.

And more, the locking member 12 can bring the abutting block 83 upwardly to separate from the cam-styled axle sleeve 16 by insertion of a key into the key hole 121, so that the cam-styled axle sleeve 16 can be forwarded to engage with the second rotation axle 28 to open the door 5 from outside of the house.

To achieve the object of theft proofing, this embodiment is provided on the electric circuit device 801 on the housing 10 of the outer lock part 1 with an alarm device 18 (as shown in FIG. 4), and the lock core rod 122 of the locking member 12 is provided thereon with a contact member 124 which can contact the alarm device 18 when the key is inserted into the key hole 121 to rotate the locking member 12 and make a loud alarm, at this time, a correct code must be input to remove the alarm.

When a code is input for getting in the house, if the times of wrong inputting that the householder set is reached, the alarm device 18 makes alarm too, and the display lamp 71 on the control panel 7 also continuously displays the message of wrongness until the householder clears off the message.

The present invention therefore holds the following advantages:

1. In the present invention, the dead bolt and the spring loaded latch bolt are directly or indirectly linked up with the rotation axle of the inner lock part, thereby, direct pressing down of the handle of the inner lock part can open the door in any situation, this can help opening the door for fleeing in an emergency, thus the safety of use can be achieved.
2. When in a unlocking state, the rotation axles of the outer and the inner lock parts of the present invention are connected with each other, hence it needs not to be locked with a key when going out, but only to raise the handles for locking, thus the convenience of use can be increased.
3. The present invention is added with an alarm device, thereby, an unexpected wants to open the door in an undue mode, a threatening and forbidding function can be provided to get the object of theft proofing.
4. The present invention is provided with a resilient-force control means to reduce the resilient force generated downwards or upwards of the handles when in retrieving after they are raised and pressed down, this can increase the years of use of the handles.
5. The present invention is provided on the outer lock part with a control panel having thereon a display lamp and push buttons, so that a user can input a correct code for unlocking, if wrong codes are input, when the times of wrong inputting that the householder set is reached, an alarm device sounds for a period of time, and the display lamp also continuously displays the message of wrongness to advise the householder of possible illegal invading and make alert of the householder.
6. The present invention is provided on the inner lock part with an indication disk on which there are different patterns, colors or codes to indicate the state of the dead bolt, and to render the householder to see whether the door is locked.

In conclusion, the present invention can get its expected objects to provide a door lock with a clutch having a cam-styled axle sleeve which is both safe and convenient for use. The above stated is only for illustrating a preferred embodiment of the present invention, and not for giving any limitation to the scope of the present invention. It will be apparent to those skilled in this art that various modifications or changes without departing from the spirit of this invention shall fall within the scope of the appended claims.

What is claimed is:

1. A door lock with a clutch having a cam-styled axle sleeve comprising:

an outer lock part including: a housing and an externally connected handle, said housing is provided therein with a rotation axle and a control device, said control device includes a motor, a gear, an abutting block and an electric circuit device, one end of said rotation axle is connected with and linked-up by said handle, while the other end of said rotation axle is telescopically connected thereover with a spring and said cam-styled axle sleeve which is provided with a central axle hole extending therethrough, said cam-styled axle sleeve is linked-up with said rotation axle when in rotating, an engaging edge is provided externally of said cam-styled axle sleeve which is a gradually beveled surface, so that said abutting block engages said cam-styled axle sleeve along said gradually beveled surface of said engaging edge for positioning said cam-styled axle sleeve, said electric circuit device receives electronic signals to control rotation of said motor to move said gear and to control raising and lowering of said abutting block, so that said cam-styled axle sleeve is controlled to be forwardly and rearwardly movable;

an inner lock part including: a housing and an externally connected handle, said housing is provided therein with a linkage and a rotation axle linking up with each other, wherein one end of said rotation axle is connected with and linked-up by said handle, while the other end of said rotation axle is engaged with a second rotation axle being engaged with said cam-styled axle sleeve of said outer lock part when in forward moving and thereby is linked-up with said cam-styled axle sleeve;

when connecting said outer lock part and said inner lock part with a door panel, said outer lock part is mounted on the outside surface of said door panel, while said inner lock part is mounted on the inside surface of said door panel in opposition to said outer lock part; while said door panel is mounted therein with a dead bolt and a spring loaded with latch bolt, said dead bolt is connected and linked up with said linkage, said spring loaded with latch bolt is connected and linked up with said second rotation axle, thereby when said handle of said inner lock part is rotated, stretching from and retracting into said door panel of said dead bolt and latch bolt are controlled for opening and locking said door lock; when said cam-styled axle sleeve of said outer lock part is connected with said second rotation axle of said inner lock part, said door panel is adapted to being opened or locked with said handle of said outer lock part.

2. The door lock with a clutch having a cam-styled axle sleeve as claimed in claim 1, wherein said cam-styled axle sleeve on said outer lock part is further provided in a slipping over mode externally thereon with a rotating ring, said rotating ring is provided separately thereon with at least two stubs, a flange protrudes out of the periphery of said rotating ring, said cam-styled axle sleeve is provided on the end face thereof with a plurality of protrusions, and said second rotation axle of said inner lock part extends outwardly to form on the tailing end thereof a sheet member of which the external surface is provided with a recess in opposition to and in engaging with said protrusions of said cam-styled axle sleeve of said outer lock part, for the purpose of engaging with said cam-styled axle sleeve during forward moving, said sheet member is further provided on the external surface thereof with a plurality of slots in corresponding by position to said stubs of said rotating ring to make pivot connection with said stubs of said rotating ring, so that said second rotation axle is also linked up with said rotating ring.

3. The door lock with a clutch having a cam-styled axle sleeve as claimed in claim 1, wherein a spring is provided between said handles and said rotation axles respectively of said outer and said inner lock parts to render said handles to retrieve its original positions after said handles are pressed down or raised.

4. The door lock with a clutch having a cam-styled axle sleeve as claimed in claim 1, wherein said outer lock part is provided on said housing thereof with a control panel in connecting with said electric circuit device in said housing, said control panel has a display lamp and push buttons, so that a user can unlock by inputting a correct code, and an alarm device is provided in said housing to threaten and forbid invading of the unexpected.

5. The door lock with a clutch having a cam-styled axle sleeve as claimed in claim 1, wherein said outer lock part is provided with a locking member of which a key hole is provided on a lateral side of said housing of said outer lock part, at the rear of said key hole there is a lock core rod which has thereon a contact member, so that when said key hole is rotated with a key, said contact member is moved to contact said alarm device; said control device has a pull rod having a spring thereon and a lid with positioning strips, said pull rod has one end thereof engaged with a protruding piece provided on said lock core rod and has the other end thereof connected with said abutting block, so that when said key hole is rotated with a key, said protruding piece of said lock core rod is moved to pull said pull rod to also move said abutting block upwardly to be released from said engaging edge of said cam-styled axle sleeve, thus said cam-styled axle sleeve moves forwardly to engage said second rotation axle of said inner lock part.

6. The door lock with a clutch having a cam-styled axle sleeve as claimed in claim 4, wherein said outer lock part is provided with a locking member of which a key hole is provided on a lateral side of said housing of said outer lock part, at the rear of said key hole there is a lock core rod which has thereon a contact member, so that when said key hole is rotated with a key, said contact member is moved to contact said alarm device; said control device has a pull rod having a spring thereon and a lid with positioning strips, said pull rod has one end thereof engaged with a protruding piece provided on said lock core rod and has the other end thereof connected with said abutting block, so that when said key hole is rotated with a key, said protruding piece of said lock core rod is moved to pull said pull rod to also move said abutting block upwardly to be released from said engaging edge of said cam-styled axle sleeve, thus said cam-styled axle sleeve moves forwardly to engage said second rotation axle of said inner lock part.

7. The door lock with a clutch having a cam-styled axle sleeve as claimed in claim 1, wherein said end of said rotation axle of said inner lock part connecting with said second rotation axle is a round plane member with a central axle hole for insertion engaging with said second rotation axle.

8. The door lock with a clutch having a cam-styled axle sleeve as claimed in claim 1, wherein said end of said rotation axle of said inner lock part connecting with said second rotation axle has on the end face thereof a central axle hole for placing therein an abutting spring and for insertion engaging with said second rotation axle.

9. The door lock with a clutch having a cam-styled axle sleeve as claimed in claim 6, wherein said end of said rotation axle of said inner lock part connecting with said second rotation axle has on the end face thereof a central axle hole for placing therein an abutting spring and for insertion engaging with said second rotation axle.

10. The door lock with a clutch having a cam-styled axle sleeve as claimed in claim 1, wherein said end of said rotation axle of said inner lock part connecting with said second rotation axle has on the end face thereof a linking portion to connect with said linkage, said linkage comprises of an inner pull rod, an axle seat and an axle connecting with said dead bolt with one end thereof and connecting said axle seat with the other end thereof, said inner pull rod is pivotally connected on one end thereof with said linking portion and connected on the other end thereof with said axle seat.

11. The door lock with a clutch having a cam-styled axle sleeve as claimed in claim 6, wherein said end of said rotation axle of said inner lock part connecting with said second rotation axle has on the end face thereof a linking portion to connect with said linkage, said linkage comprises of an inner pull rod, an axle seat and an axle connecting with said dead bolt with one end thereof and connecting said axle seat with the other end thereof, said inner pull rod is pivotally connected on one end thereof with said linking portion and connected on the other end thereof with said axle seat.

12. The door lock with a clutch having a cam-styled axle sleeve as claimed in claim 8, wherein said axle seat has thereon two lateral connecting arms, one of said connecting arms forms pivot connection with said inner pull rod, an engaging seat is provided near said axle seat, said engaging seat is engaged thereon with a spring, the other of said connecting arms of said engaging seat is engaged with the other end of said spring, thereby the resilient forces of said handles of said inner and outer lock parts generated when in retrieving of said handles by position after said handles are raised and pressed down are reduced.

* * * * *